US010011886B2

(12) United States Patent
Takajo et al.

(10) Patent No.: US 10,011,886 B2
(45) Date of Patent: Jul. 3, 2018

(54) GRAIN-ORIENTED ELECTRICAL STEEL SHEET AND MANUFACTURING METHOD THEREOF

(71) Applicant: JFE Steel Corporation, Tokyo (JP)

(72) Inventors: Shigehiro Takajo, Tokyo (JP); Hiroi Yamaguchi, Tokyo (JP); Takeshi Omura, Tokyo (JP); Hirotaka Inoue, Tokyo (JP); Seiji Okabe, Tokyo (JP)

(73) Assignee: JFE Steel Corporation (JP)

( * ) Notice: Subject to any disclaimer, the term of this patent is extended or adjusted under 35 U.S.C. 154(b) by 806 days.

(21) Appl. No.: 14/347,759

(22) PCT Filed: Sep. 28, 2012

(86) PCT No.: PCT/JP2012/006244
§ 371 (c)(1),
(2) Date: Mar. 27, 2014

(87) PCT Pub. No.: WO2013/046716
PCT Pub. Date: Apr. 4, 2013

(65) Prior Publication Data

US 2014/0234638 A1 Aug. 21, 2014

(30) Foreign Application Priority Data

Sep. 28, 2011 (JP) ..... 2011-212376

(51) Int. Cl.
*C21D 8/12* (2006.01)
*C22C 38/04* (2006.01)
(Continued)

(52) U.S. Cl.
CPC ..... *C21D 8/1277* (2013.01); *C21D 1/38* (2013.01); *C21D 8/12* (2013.01); *C21D 8/1283* (2013.01);
(Continued)

(58) Field of Classification Search
CPC ..... C21D 2201/05; C21D 8/12; H01F 1/18
(Continued)

(56) References Cited

U.S. PATENT DOCUMENTS 6,280,862 B1 8/2001 Inokuti
2005/0126659 A1 6/2005 Homma et al.
(Continued)

FOREIGN PATENT DOCUMENTS

EP 1 227 163 7/2002
JP 62-96617 A 5/1987
(Continued)

OTHER PUBLICATIONS

NPL: Machine translation of JP06002042A, Jan. 1994.*
(Continued)

*Primary Examiner* — Jie Yang
(74) *Attorney, Agent, or Firm* — DLA Piper LLP (US)

(57) ABSTRACT

A grain-oriented electrical steel sheet to which electron beam irradiation is applied, has a film and a thickness of t (mm), wherein no rust is produced on a surface of the steel sheet after a humidity cabinet test lasting 48 hours at a temperature of 50° C. in an atmosphere of 98% humidity, and iron loss $W_{17/50}$ after the electron beam irradiation is reduced by at least $(-500\ t^2+200\ t-6.5)$ % of the iron loss $W_{17/50}$ before the electron beam irradiation and is $(5\ t^2-2\ t+1.065)$ W/kg or less.

6 Claims, 3 Drawing Sheets

(51) Int. Cl.

| | |
|---|---|
| ***C22C 38/60*** | (2006.01) |
| ***H01F 1/16*** | (2006.01) |
| ***H01F 1/18*** | (2006.01) |
| ***C22C 38/00*** | (2006.01) |
| ***C22C 38/02*** | (2006.01) |
| ***C22C 38/06*** | (2006.01) |
| ***C22C 38/08*** | (2006.01) |
| ***C23C 30/00*** | (2006.01) |
| ***C21D 1/38*** | (2006.01) |

(52) U.S. Cl.
CPC ..... *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/60* (2013.01); *C23C 30/00* (2013.01); *H01F 1/16* (2013.01); *H01F 1/18* (2013.01); *C21D 2201/05* (2013.01)

(58) Field of Classification Search
USPC ..... 148/306
See application file for complete search history.

(56) References Cited

U.S. PATENT DOCUMENTS

| | | | |
|---|---|---|---|
| 2014/0234638 | A1 | 8/2014 | Takajo et al. |
| 2014/0360629 | A1 | 12/2014 | Inoue et al. |
| 2015/0010762 | A1 | 1/2015 | Yamaguchi et al. |

FOREIGN PATENT DOCUMENTS

| | | | |
|---|---|---|---|
| JP | 2-8027 | B2 | 2/1990 |
| JP | 2-277780 | A | 11/1990 |
| JP | 3-13293 | B2 | 2/1991 |
| JP | 3-260020 | A | 11/1991 |
| JP | 4-39852 | A | 2/1992 |
| JP | 5-311241 | A | 11/1993 |
| JP | 5-335128 | A | 12/1993 |
| JP | 6-2042 | A | 1/1994 |
| JP | 7-65106 | B2 | 7/1995 |
| JP | 7-65108 | | 7/1995 |
| JP | 10-298654 | A | 11/1998 |
| JP | 2002-012918 | A | 1/2002 |
| JP | 4123679 | B2 | 5/2008 |
| JP | 2012-36450 | A | 2/2012 |

OTHER PUBLICATIONS

Korean Notice of Grounds for Rejection dispatched Jun. 9, 2015 along with its English translation from corresponding Korean Patent Application No. 2014-7010154.

Chinese Second Notice of Review Comments dispatched Jul. 31, 2015 along with its English translation from corresponding Chinese Patent Application No. 2012800478366.

Japanese Notice of Reasons for Rejection dispatched Apr. 1, 2014, along with an English translation, from corresponding Japanese Application No. 2013-535941.

I. Ichijima et al., "Improvement of Magnetic Properties in Thinner HI-B with Domain-Refinement," IEEE Transactions on Magnetics, vol. MAG-20, No. 5, Sep. 1984, pp. 1557-1559.

Office Action dated May 23, 2016, of related U.S. Appl. No. 14/368,975.

Office Action dated Jan. 6, 2016, of related U.S. Appl. No. 14/368,975.

* cited by examiner

GRAIN-ORIENTED ELECTRICAL STEEL SHEET AND MANUFACTURING METHOD THEREOF

TECHNICAL FIELD

This disclosure relates to a grain-oriented electrical steel sheet suitable for use as an iron core of a transformer or the like and having excellent iron loss properties without deterioration of corrosion resistance, and to a method of manufacturing the grain-oriented electrical steel sheet.

BACKGROUND

In recent years, energy use has become more and more efficient, and demands are increasingly being made, mainly from transformer manufacturers and the like, for an electrical steel sheet with high flux density and low iron loss.

The flux density can be improved by accumulating crystal orientations of the electrical steel sheet in the Goss orientation. JP4123679B2, for example, discloses a method of manufacturing a grain-oriented electrical steel sheet having a flux density $B_8$ exceeding 1.97 T.

With regards to iron loss, measures have been devised from the perspectives of increasing purity of the material, high orientation, reduced sheet thickness, addition of Si and Al, magnetic domain refining, and the like (for example, see "Recent progress in soft magnetic steels", 155th/156th Nishiyama Memorial Technical Seminar, The Iron and Steel Institute of Japan, Feb. 1, 1995). In a high flux density material in which $B_8$ exceeds 1.9 T, however, iron loss properties tend to worsen as the flux density is higher, in general. The reason is that when the crystal orientations are aligned, the magnetostatic energy decreases and, therefore, the magnetic domain width widens, causing eddy current loss to rise. To address this issue, one method of reducing the eddy current loss is to apply magnetic domain refining by enhancing the film tension or introducing thermal strain. Generally, film tension is applied using the difference in thermal expansion between the film and the steel substrate, by forming a film on a steel sheet that has expanded at a high temperature and then cooling the steel sheet to room temperature. Techniques to increase the tension effect without changing the film material, however, are reaching saturation. On the other hand, with the method of improving film tension disclosed in Ichijima et al., IEEE TRANSACTIONS ON MAGNETICS, Vol. MAG-20, No.5 (1984), p. 1558, FIG. 4, the strain is applied near the elastic region, and tension only acts on the surface layer of the steel substrate, leading to the problem of a small iron loss reduction effect.

Possible methods of introducing thermal strain include using a laser, an electron beam, or a plasma jet. All of these are known to achieve an extremely strong improvement effect in iron loss due to irradiation.

For example, JP7-65106B2 discloses a method of manufacturing an electrical steel sheet having iron loss $W_{17/50}$ of below 0.8 W/kg due to electron beam irradiation. Furthermore, JP3-13293B2 discloses a method of reducing iron loss by applying laser irradiation to an electrical steel sheet.

When using a laser, electron beam, or plasma jet to introduce thermal strain under conditions that greatly improve iron loss properties, however, the film on the irradiation surface may in some cases rupture, exposing the steel substrate and leading to a remarkable degradation in the corrosion resistance of the steel sheet after irradiation. A method that introduces thermal strain with a plasma jet to not impair the corrosion resistance is known (see JP62-96617A). However, that method requires that the distance between the plasma nozzle and the irradiation surface be controlled in μm increments, causing a considerable loss of operability.

In the case of a laser, techniques exist to suppress damage to the film due to irradiation by lowering the laser power density through a change in the beam shape, as disclosed in JP2002-12918A and JP10-298654A. Even if the laser is widened in the irradiation direction to increase the irradiation area, however, heat near the irradiated portion does not spread sufficiently when the irradiation speed is high, but rather accumulates, which raises the temperature and ends up damaging the film. Furthermore, when attempting to achieve an iron loss reduction effect equal to or greater than the values disclosed in JP '918 or JP '654 (such as 15% or more) with a laser, irradiation at a higher output becomes necessary, making it impossible to avoid damage to the film.

As a method of preventing degradation of corrosion resistance when applying laser irradiation to the steel sheet surface, the irradiated surface may be recoated after irradiation to guarantee corrosion resistance. Recoating after irradiation, however, not only increases the cost of the product, but also presents the problems of increased sheet thickness and a decreased stacking factor upon use as an iron core.

By contrast, when irradiating with an electron beam, JP5-311241A and JP6-2042A, respectively, disclose methods of suppressing damage to the film due to irradiation by configuring the irradiation beam in sheet form (JP '241) and by using a beam with a single stage diaphragm and forming the filament shape as a ribbon (JP '042). Furthermore, JP2-277780A discloses achieving a steel sheet with no damage to the film by press fitting a film to a steel substrate with a high acceleration voltage, low current electron beam.

With the method to configure the electron beam in sheet form, however, output at the inner portion of the sheet-form irradiation surface is not uniform, leading to problems such as troublesome adjustment of the optical system. Also, under electron beam irradiation conditions for which iron loss decreases further, it was revealed that damage to the film due to irradiation occurs when forming the filament in a ribbon shape or adopting a single stage diaphragm. Furthermore, the method disclosed in JP '780 not only requires strain removal annealing after electron beam irradiation but also cannot be said to achieve a sufficient iron loss reduction effect.

It could therefore be helpful to provide a grain-oriented electrical steel sheet suitable for use as an iron core of a transformer or the like and having low iron loss without deterioration of corrosion resistance, as well as a method of manufacturing the grain-oriented electrical steel sheet.

SUMMARY

We discovered that by using an electron beam generated with a high acceleration voltage, it is possible to achieve both a decrease in iron loss and suppression of damage to the film. Specifically, we discovered that iron loss after electron beam radiation strongly depends on the irradiation energy per unit area (for example, when irradiating with the electron beam in point form, this value is the sum of the irradiation energy provided by the irradiation points included in a certain region divided by the area of the region). We also discovered that by adjusting the irradiation energy per unit area, iron loss properties are not significantly affected even if the irradiation energy per unit length along the electron beam irradiation line is lowered. Furthermore, we discovered that adjusting the electron beam irradiation conditions as indicated below yields good iron loss properties and suppresses damage to the film due to electron beam irradiation. Note that in (1) and (2) below, Z represents the irradiation frequency (kHz) raised to the −0.35 power.

(1) The irradiation energy of the electron beam is 1.0 Z J to 3.5 Z J per unit area of 1 $cm^2$.

(2) The irradiation energy of the electron beam is 105 Z J or less per unit length of 1 m.

We thus provide:

[1] A grain-oriented electrical steel sheet to which electron beam irradiation is applied, having a film and a thickness oft (mm), wherein no rust is produced on a surface of the steel sheet after a humidity cabinet test lasting 48 hours at a temperature of 50° C. in an atmosphere of 98% humidity, and an iron loss $W_{17/50}$ after the electron beam irradiation is reduced by at least $(-500\,t^2+200\,t-6.5)$ % of the iron loss $W_{17/50}$ before the electron beam irradiation and is $(5\,t^2-2\,t+1.065)$ W/kg or less.

[2] The grain-oriented electrical steel sheet according to [1], wherein the film includes a film formed from colloidal silica and phosphate, and a forsterite film that is a base film of the film formed from colloidal silica and phosphate.

[3] A method of manufacturing a grain-oriented electrical steel sheet having a film, comprising: in irradiating the grain-oriented electrical steel sheet with an electron beam in a direction intersecting a rolling direction, setting electron beam irradiation conditions such that an irradiation energy of the electron beam per unit area of 1 $cm^2$ is 1.0 Z J to 3.5 Z J and the irradiation energy of the electron beam per unit irradiation length of 1 m is 105 Z J or less, where an irradiation time per irradiation interval d (mm) of the electron beam is $s_1$ (ms), and $Z=s_1^{0.35}$.

[4] The method of manufacturing a grain-oriented electrical steel sheet according to [3], further comprising setting the irradiation interval d (mm) in a range of 0.01 mm to 0.5 mm and setting the irradiation time $s_1$ (ms) in a range of 0.003 ms to 0.1 ms.

[5] The method of manufacturing a grain-oriented electrical steel sheet according to [3] or [4], wherein the film includes a film formed from colloidal silica and phosphate, and a forsterite film that is a base film of the film formed from colloidal silica and phosphate.

Not only can iron loss of a grain-oriented electrical steel sheet due to electron beam irradiation be vastly improved, but also rupture of the film at the irradiated portion can be suppressed so that deterioration of corrosion resistance can be effectively prevented. Additionally, a film recoating process after electron beam irradiation can be omitted, thereby not only lowering the cost of the product but also making it possible to improve the stacking factor when forming an iron core of a transformer or the like, since the film thickness does not increase.

DETAILED DESCRIPTION

Figure 1:
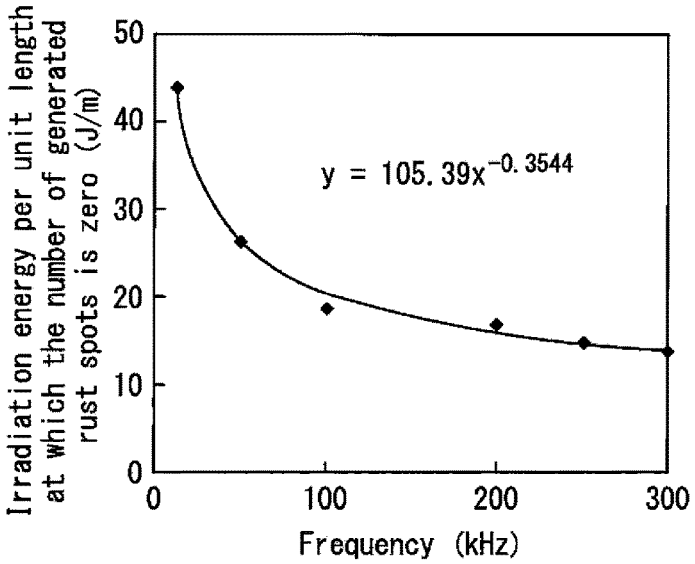
FIG. 1 is a graph illustrating the relationship between frequency and the maximum irradiation energy at which the number of generated rust spots is zero.

The following describes our steel sheets and methods in detail.

First, the manufacturing conditions of a grain-oriented electrical steel sheet are described.

Any chemical composition that allows secondary recrystallization to proceed may be used as the chemical composition of a slab for a grain-oriented electrical steel sheet. The chemical composition may contain appropriate amounts of Al and N in the case where an inhibitor, e.g., an AlN-based inhibitor, is used or appropriate amounts of Mn and Se and/or S in the case where an MnS.MnSe-based inhibitor is used. Of course, these inhibitors may also be used in combination. In this case, preferred contents of Al, N, S and Se are: Al: 0.01 mass % to 0.065 mass %; N: 0.005 mass % to 0.012 mass %; S: 0.005 mass % to 0.03 mass %; and Se: 0.005 mass % to 0.03 mass %, respectively.

Furthermore, our grain-oriented electrical steel sheets may have limited contents of Al, N, S and Se without using an inhibitor.

In this case, the contents of Al, N, S and Se are preferably limited to Al: 100 mass ppm or less, N: 50 mass ppm or less, S: 50 mass ppm or less, and Se: 50 mass ppm or less, respectively.

Other than the aforementioned components, specific examples of basic components and optionally added components of a slab for the grain-oriented electrical steel sheet are as follows.

C: 0.08 Mass % or Less

Carbon (C) is added to improve the texture of a hot-rolled sheet. However, to reduce the C content to 50 mass ppm or less during the manufacturing process, at which point magnetic aging will not occur, the C content is preferably 0.08 mass % or less. It is not necessary to set a particular lower limit to the C content because secondary recrystallization is enabled by a material not containing C.

Si: 2.0 Mass % to 8.0 Mass %

Silicon (Si) is an element effective in enhancing electrical resistance of steel and improving iron loss properties thereof. The Si content in steel is preferably 2.0 mass % or more to achieve a sufficient iron loss reduction effect. On the other hand, Si content above 8.0 mass % significantly deteriorates formability and also decreases the flux density of the steel. Therefore, the Si content is preferably 2.0 mass % to 8.0 mass %.

Mn: 0.005 Mass % to 1.0 Mass %

Manganese (Mn) is a necessary element to achieve better hot workability of steel. However, this effect is inadequate when the Mn content in steel is below 0.005 mass %. On the other hand, Mn content in steel above 1.0 mass % deteriorates magnetic flux of a product steel sheet. Accordingly, the Mn content is preferably 0.005 mass % to 1.0 mass %.

Furthermore, in addition to the above basic components, the slab may also contain the following as elements to improve magnetic properties as deemed appropriate: at least one element selected from Ni: 0.03 mass % to 1.50 mass %, Sn: 0.01 mass % to 1.50 mass %, Sb: 0.005 mass % to 1.50 mass %, Cu: 0.03 mass % to 3.0 mass %, P: 0.03 mass % to 0.50 mass %, Mo: 0.005 mass % to 0.10 mass %, and Cr: 0.03 mass % to 1.50 mass %.

Nickel (Ni) is an element useful to improve the texture of a hot rolled steel sheet for better magnetic properties thereof. However, Ni content in steel below 0.03 mass % is less effective in improving magnetic properties, while Ni content in steel above 1.50 mass % makes secondary recrystallization of the steel unstable, thereby deteriorating the magnetic properties thereof. Thus, Ni content is preferably 0.03 mass % to 1.50 mass %.

In addition, tin (Sn), antimony (Sb), copper (Cu), phosphorus (P), molybdenum (Mo) and chromium (Cr) are useful elements in terms of improving magnetic properties of steel. However, each of these elements becomes less effective in improving magnetic properties of the steel when contained in steel in an amount less than the aforementioned lower limit and inhibits the growth of secondary recrystallized grains of the steel when contained in steel in an amount exceeding the aforementioned upper limit. Thus, each of these elements is preferably contained within the respective ranges thereof specified above.

The balance other than the above-described elements is Fe and incidental impurities incorporated during the manufacturing process.

Next, the slab having the above-described chemical composition is subjected to heating before hot rolling in a conventional manner. However, the slab may also be subjected to hot rolling directly after casting, without being subjected to heating. In the case of a thin slab or thinner cast steel, it may be subjected to hot rolling or directly proceed to the subsequent step, omitting hot rolling.

Furthermore, the hot rolled sheet is optionally subjected to hot band annealing. At this time, to obtain a highly-developed Goss texture in a product sheet, a hot band annealing temperature is preferably 800° C. to 1100° C. If a hot band annealing temperature is lower than 800° C., there remains a band texture resulting from hot rolling, which makes it difficult to obtain a primary recrystallization texture of uniformly-sized grains and impedes the growth of secondary recrystallization. On the other hand, if a hot band annealing temperature exceeds 1100° C., the grain size after the hot band annealing coarsens too much, which makes it extremely difficult to obtain a primary recrystallization texture of uniformly-sized grains.

After the hot band annealing, the sheet is subjected to cold rolling once, or twice or more with intermediate annealing performed therebetween, followed by recrystallization annealing and application of an annealing separator to the sheet. After application of the annealing separator, the sheet is subjected to final annealing for purposes of secondary recrystallization and formation of a forsterite film.

After final annealing, it is effective to subject the sheet to flattening annealing to correct the shape thereof. Insulation coating is applied to the surfaces of the steel sheet before or after the flattening annealing. As used herein, "insulation coating" refers to coating that may apply tension to the steel sheet to reduce iron loss (hereinafter, referred to as tension coating). Any known tension coating used in a grain-oriented electrical steel sheet may be used similarly as the tension coating, yet a tension coating formed from colloidal silica and phosphate is particularly preferable. Examples include inorganic coating containing silica, and ceramic coating formed by physical deposition, chemical deposition, and the like.

The grain-oriented electrical steel sheet after the above-described tension coating is subjected to magnetic domain refining treatment by irradiating the surfaces of the steel sheet with an electron beam under the conditions indicated below. The iron loss reduction effect can be fully achieved with electron beam irradiation while suppressing damage to the film.

Next, the method of irradiation with an electron beam is described.

First, the conditions to generate the electron beam are described.

Acceleration Voltage: 40 kV to 300 kV

A higher acceleration voltage is better. An electron beam generated at a high acceleration voltage tends to pass through matter, in particular material formed from light elements. In general, a forsterite film and a tension coating are formed from light elements and, therefore, if the acceleration voltage is high, the electron beam passes through them easily, making the film less susceptible to damage. A higher acceleration voltage above 40 kV is preferable since the irradiation beam current necessary to obtain the same output is low, and the beam diameter can be narrowed. Upon exceeding 300 kV, however, the irradiation beam current becomes excessively low, which may make it difficult to perform minute adjustments thereof.

Irradiation Diameter: 350 μm or Less

At a large irradiation diameter exceeding 350 μm, the heat affected region expands, which may cause iron loss (hysteresis loss) properties to deteriorate. Therefore, a value of 350 μm or less is preferable. Measurement was made using the half width of a current (or voltage) curve obtained by a known slit method. While no lower limit is placed on the irradiation diameter, an excessively small value leads to an excessively high beam energy density, which makes it easier for damage to the film due to irradiation to occur. Therefore, the irradiation diameter is preferably set to approximately 100 μm or more.

Electron Beam Irradiation Pattern

The irradiation pattern of the electron beam is not limited to a straight line. The steel sheet may be irradiated from one widthwise edge to the other widthwise edge in a regular pattern such as a wave or the like. A plurality of electron guns may also be used, with an irradiation region being designated for each gun.

For irradiation in the widthwise direction of the steel sheet, a deflection coil is used, and irradiation is repeated along irradiation positions at a constant interval d (mm) with an irradiation time of $s_1$. These irradiation points are referred to as dots. At this time, the constant interval d (mm) is preferably set within a predetermined range. This interval d is referred to as dot pitch. Since the time in which the electron beam traverses the interval d is extremely short, the inverse of $s_1$can be considered as the irradiation frequency.

Furthermore, the above irradiation from one widthwise edge to the other widthwise edge is repeated in a direction intersecting the rolling direction of the irradiated material with a constant interval between repetitions. This interval is referred to below as line spacing. With respect to a direction perpendicular to the rolling direction of the steel plate, the irradiation direction preferably forms an angle of approximately ±30°.

Irradiation Time Per Dot (Inverse of Irradiation Frequency) $s_1$: 0.003 ms to 0.1 ms (3 μs to 100 μs)

If the irradiation time $s_1$ is less than 0.003 ms, a sufficient heat effect cannot be obtained for the steel substrate, and iron loss properties might not improve. On the other hand, with a time of longer than 0.1 ms, the irradiated heat becomes dispersed throughout the steel and the like during the irradiation time. Therefore, even if the irradiation energy per dot expressed as $V \times I \times s_1$ is constant, the maximum attained temperature of the irradiated portion tends to decrease, and the iron loss properties might deteriorate. Accordingly, the irradiation time $s_1$ is preferably 0.003 ms to 0.1 ms. V represents the acceleration voltage, and I represents the beam current.

Dot Pitch (d): 0.01 mm to 0.5 mm

A dot pitch wider than 0.5 mm causes portions of the steel substrate not to receive the heat effect. The magnetic domain is therefore not sufficiently refined, and the iron loss properties might not improve. On the other hand, at a dot pitch narrower than 0.01 mm, the irradiation speed reduces excessively, causing irradiation efficiency to drop. Accordingly, the dot pitch is preferably 0.01 mm to 0.5 mm.

Line Spacing: 1 mm to 15 mm

If the line spacing is narrower than 1 mm, the heat affected region expands, which may cause iron loss (hysteresis loss) properties to deteriorate. On the other hand, if the line spacing is wider than 15 mm, magnetic domain refining is insufficient, and the iron loss properties tend not to improve. Accordingly, the line spacing is preferably 1 mm to 15 mm.

Pressure in Pressure Chamber: 3 Pa or Less

If the pressure in the pressure chamber is higher than 3 Pa, electrons generated from the electron gun scatter, and the electron energy that provides the heat effect to the steel substrate reduces. As a result, magnetic domain refining is not sufficiently achieved, and iron loss properties might not improve. No particular lower limit is established, and a lower pressure in the pressure chamber is better.

With respect to focusing current, it goes without saying that the focusing current is adjusted in advance so that the beam is uniform in the widthwise direction when irradiating by deflecting in the widthwise direction. For example, applying a dynamic focus function (see JP '852) presents no problem whatsoever.

Irradiation Energy Per Unit Irradiation Length of 1 m of Electron Beam: 105 Z J or Less Z is a value representing $s_1^{0.35}$ or the irradiation frequency (kHz) raised to the −0.35 power. In general, as the irradiation energy per unit length in the widthwise direction of the steel sheet is higher, magnetic domain refining progresses, and eddy current loss decreases. When irradiating with excessive energy, however, not only does hysteresis loss increase, but also the beam irradiated portion reaches an excessively high temperature, causing damage to the film. Therefore, as explained below, a certain value (105 Z J/m) or less is an adequate condition. As long as the magnetic domain refining effect is obtained, no particular lower limit is established, yet a lower limit of approximately 60 Z J/m is preferable.

Furthermore, the magnetic domain refining and damage to the film due to heat irradiation are presumably influenced by the maximum attained temperature of the irradiated portion, the resulting amount of expansion of the iron and the like. When the frequency is low, i.e., when $s_1$ is large, and thermal diffusion throughout the steel during irradiation is pronounced so that the irradiated portion does not reach a high temperature, it should be noted that unless a larger amount of energy is irradiated, iron loss will therefore not be reduced and, moreover, damage to the film might not occur.

We derived the value of Z based on experiments.

Specifically, ten 0.23 mm thick sheets with a tension coating were prepared under the same conditions as the Examples described below, and electron beam irradiation was performed at the frequencies listed in Table 1. The minimum irradiation energy was also obtained when, for even one sample, the visually confirmed number of generated rust spots was zero after a humidity cabinet test to expose the samples for 48 hours at a temperature of 50° C. in a humid environment of 98% humidity. The results are listed in Table 1.

The results for the maximum irradiation energy were plotted as a graph, shown in FIG. 1. As illustrated in FIG. 1, curve fitting was performed with the method of least squares to derive the above-described upper limit (105 Z J/m).

TABLE 1

| Frequency (kHz) | Irradiation energy per unit length at which the number of generated rust spots is zero (J/m) |
|---|---|
| 12.5 | 44 |
| 50 | 26 |
| 100 | 19 |
| 200 | 17 |
| 250 | 15 |
| 300 | 14 |

Letting L (m) be the length of the straight line or curve exposed to electron beam irradiation from one widthwise edge of the steel sheet to the other widthwise edge, the energy per unit length is defined as all of the energy irradiated in the region, divided by L.

Figure 2:
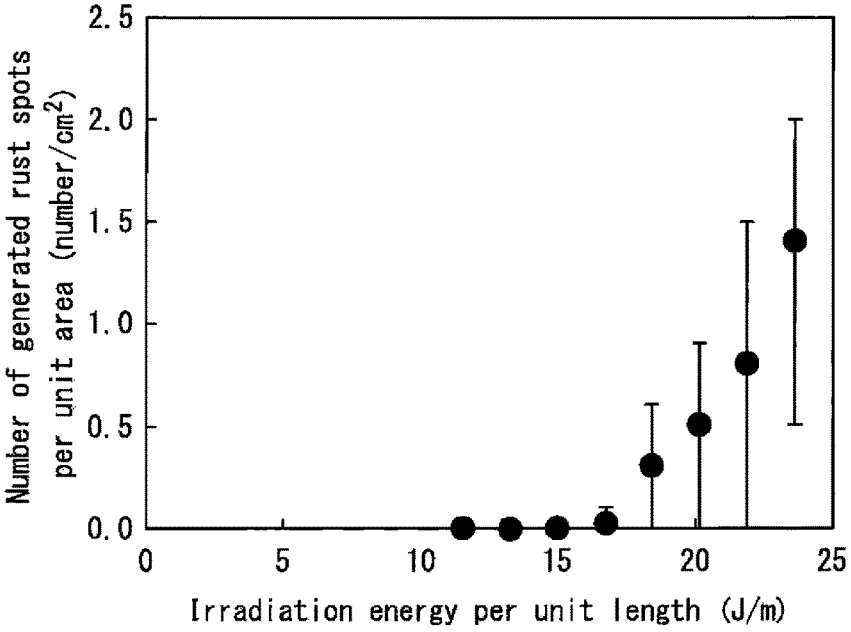
FIG. 2 is a graph illustrating the effect of the irradiation energy per unit length on the corrosion resistance after electron beam irradiation at a frequency of 100 kHz.

FIG. 2 illustrates the effect of the irradiation energy per unit length on the corrosion resistance after irradiation with an electron beam at a frequency of 100 kHz. The electron beam irradiation conditions were an acceleration voltage of 60 kV, dot pitch of 0.35 mm, and line spacing of 5 mm. On samples with a shape of 5 cm×10 cm and a sheet thickness of 0.23 mm, a humidity cabinet test was performed to expose the samples for 48 hours at a temperature of 50° C. in a humid environment of 98% humidity, after which the amount of rust generated on the electron beam irradiation surface was visually measured for evaluation as the number of spots generated per unit area.

As a result, we confirmed that by lowering the irradiation energy per unit length, the amount of rust generated can be suppressed. Note that in FIG. 2, the data width in the vertical axis direction represents the maximum and minimum values during measurement for N equal to 10. This shows that by setting the irradiation energy per unit length to 105 Z=21 J/m or less, the generation of rust is effectively suppressed.

Irradiation Energy Per Unit Area (1 $cm^2$) of Irradiated Material: 1.0 Z J to 3.5 Z J When considering the effect that the frequency of irradiation has on iron loss, an effect on the maximum attained temperature of the irradiated portion, for example, can be presumed as described above. Therefore, Z is also useful when deriving the irradiation energy to optimize iron loss properties.

Table 2 lists the minimum and maximum irradiation energy for which the iron loss reduction ratio is 13% or more (iron loss reduction amount of 0.13 W/kg or more). Considering the results, the irradiation energy of the electron beam that optimizes iron loss properties is derived as being from Z to 3.5 Z per unit area of 1 $cm^2$.

TABLE 2

| Frequency (kHz) | Minimum irradiation energy for which iron loss reduction amount is 0.13 W/kg or more ($J/cm^2$) | Maximum irradiation energy for which iron loss reduction amount is 0.13 W/kg or more ($J/cm^2$) |
|---|---|---|
| 12.5 | 0.40 | 1.40 |
| 50 | 0.25 | 0.90 |
| 100 | 0.21 | 0.70 |
| 200 | 0.15 | 0.54 |
| 250 | 0.15 | 0.50 |
| 300 | 0.14 | 0.49 |

To set the iron loss reduction ratio ΔW (%) at iron loss $W_{17/50}$ to 13% (corresponding to an iron loss reduction amount of 0.13 W/kg in the steel sheet used in the present experiment) or more, which is a higher value than the 12% disclosed in JP '654, the range of the irradiation energy per unit area was set, and treating the range as proportional to Z, the proportional coefficient was calculated. For the samples used to calculate the results in Table 2, the flux density $B_8$ before irradiation was from 1.90 T to 1.92 T.

Figure 3:
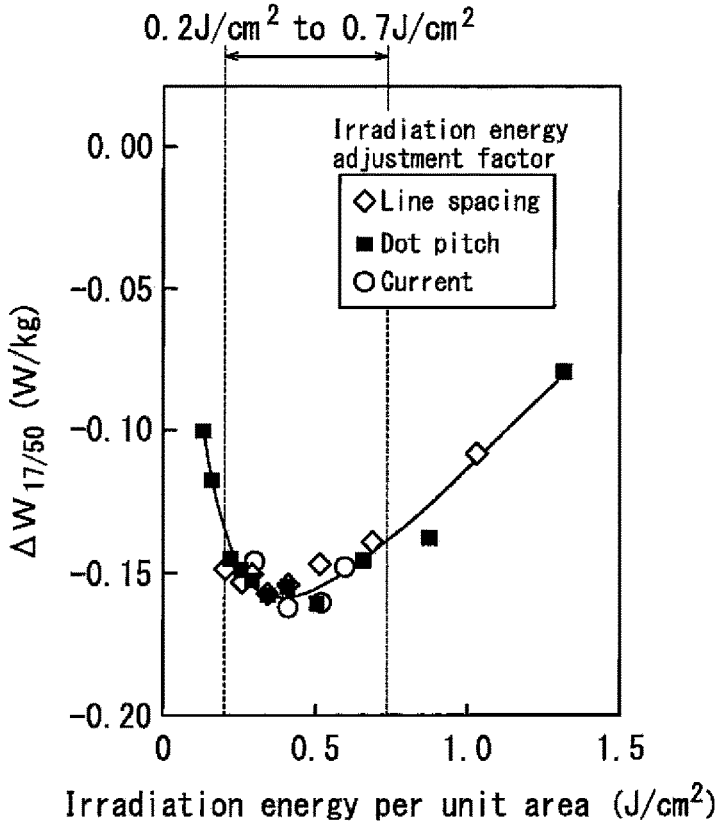
FIG. 3 is a graph illustrating the relationship between the amount of change in the iron loss $W_{17/50}$ due to electron beam irradiation (iron loss after irradiation—iron loss before irradiation) and the irradiation energy per unit area at a frequency of 100 kHz.

FIG. 3 illustrates the relationship between the amount of change in the iron loss $W_{17/50}$ due to electron beam irradiation (iron loss after irradiation—iron loss before irradiation) and the irradiation energy per unit area at a frequency of 100 kHz. FIG. 3 confirms that when the irradiation energy of the electron beam is from 1.0 Z to 3.5 Z (0.2 to 0.7) $J/cm^2$, iron loss is reduced. We discovered for the first time during the above-described experiment that, as illustrated in FIG. 3, the amount of change in the iron loss $W_{17/50}$ does not depend on the energy adjustment method such as the irradiation line spacing, the dot pitch, or the beam current, but rather can be regulated with the irradiation energy per unit area. Note that irradiation at this time was performed under the above conditions to generate the electron beam. The irradiation energy per unit area is the total amount of energy irradiated over an area of the sample used for magnetic measurement divided by the area.

By satisfying each of the above conditions, a grain-oriented electrical steel sheet can be obtained for which the iron loss reduction effect due to the electron beam irradiation can be sufficiently achieved, while damage to the film is suppressed and corrosion resistance is maintained.

The characteristics of the grain-oriented electrical steel sheet are described below:

Iron loss reduction ratio ΔW (%): $(-500\ t^2+200\ t-6.5)$ % or more

Iron loss $W_{17/50}$ after irradiation: $(5\ t^2-2\ t+1.065)$ W/kg or less.

With conventional techniques as well, if irradiation with an electron beam is performed under conditions in which the iron loss reduction effect is weak, no damage to the film occurs and, therefore, cannot be discussed without reference to the iron loss reduction effect.

The iron loss reduction ratio ΔW (%) prescribed in the experiment is, for a sheet thickness of 0.23 mm, set to 13% or more, a higher value than the 12% disclosed in JP '654, as described above. In this case, the iron loss reduction ratio is affected by the sheet thickness t (mm), yet in FIG. 4 of Ichijima et al., the iron loss reduction ratio is $\Delta W=-500\ t^2+200\ t-\alpha$ ($\alpha$: 7.5 to 9) and, therefore, the higher iron loss reduction ratio of $(-500\ t^2+200\ t-6.5)$ % or more was set as the iron loss reduction ratio prescribed. Since the iron loss before irradiation for the material used in the experiment was 0.86 W/kg to 0.88 W/kg, a reduction of 13% corresponds to a reduction of 0.11 W/kg in terms of the absolute value of the reduction amount.

The iron loss before irradiation strongly affects the iron loss reduction amount and, therefore, in the experiment, the iron loss reduction amount is confined to the above narrow range. Realistically, however, the iron loss of the grain-oriented electrical steel sheet before the electron beam irradiation is approximately 1.0 W/kg for high-quality material (for a sheet thickness of 0.23 mm). When the above $(-500\ t^2+200\ t-6.5)$ % iron loss reduction is performed on this electrical steel sheet, the iron loss is $(5\ t^2-2\ t+1.065)$ W/kg for $W_{17/50}$, and, therefore, the iron loss achieved is limited to a range equal to or less than this value. For material with an iron loss before irradiation of less than 1.0 W/kg, the iron loss after electron beam irradiation may of course be less than $(5\ t^2-2\ t+1.065)$ W/kg as long as the iron loss is reduced by $(-500\ t^2+200\ t-6.5)$ %.

Determination of film rupture is made by performing a humidity cabinet test, which is a type of corrosion resistance test such as the one described above and quantifying the amount of generated rust appearing along the irradiated portion. Specifically, test pieces after electron beam irradiation were exposed for 48 hours in an environment at a temperature of 50° C. and 98% humidity, and it was determined whether rust was generated on the surface of the steel sheets, in particular in the region affected by heat from the electron beam. The determination of whether rust was generated was made visually by checking for a change in color, and the amount was evaluated as the number of spots generated per unit area. When rust generation was pronounced, however, and rust in one location covered a wide region, the amount was evaluated as the rust generation area ratio.

Other than the above-described steps and manufacturing conditions, a conventionally known method of manufacturing a grain-oriented electrical steel sheet subjected to magnetic domain refining treatment using an electron beam may be adopted.

EXAMPLES

A steel slab containing the chemical composition shown in Table 3 was produced by continuous casting and heated to 1430° C. and subjected to hot rolling to form a hot rolled steel sheet having a sheet thickness of 1.6 mm. The hot rolled steel sheet thus obtained was then subjected to hot band annealing at 1000° C. for 10 seconds. The steel sheet was then subjected to cold rolling to have a sheet thickness of 0.55 mm. The cold rolled steel sheet thus obtained was subjected to intermediate annealing under the conditions of a degree of atmospheric oxidation $PH_2O/PH_2$ of 0.37, a temperature of 1100° C., and a duration of 100 seconds. Subsequently, each steel sheet was subjected to hydrochloric acid pickling to remove subscales from the surfaces thereof, followed by cold rolling again to be finished to a cold-rolled sheet having a sheet thickness of 0.20 mm to 0.30 mm.

TABLE 3

| Chemical composition | | | | | | | | |
|---|---|---|---|---|---|---|---|---|
| C (mass ppm) | Si (mass %) | Mn (mass %) | Ni (mass %) | O (mass ppm) | N (mass ppm) | Al (mass ppm) | Se (mass ppm) | S (mass ppm) |
| 500 | 2.95 | 0.1 | 0.01 | 25 | 65 | 250 | 105 | 30 |

Then, each steel sheet was subjected to decarburization by being kept at a degree of atmospheric oxidation $PH_2O/PH_2$ of 0.45 and a soaking temperature of 850° C. for 150 seconds. An annealing separator composed mainly of MgO was then applied to each steel sheet. Thereafter, each steel sheet was subjected to final annealing for the purposes of secondary recrystallization and purification under the conditions of 1180° C. and 60 hours.

In this final annealing, the average cooling rate during a cooling process at a temperature range of 700° C. or higher was varied. A tension coating composed of 50% of colloidal silica and magnesium phosphate was then applied to each steel sheet, and the iron loss was measured. The iron loss was as follows: eddy current loss (1.7 T, 50 Hz) was 0.54 W/kg to 0.55 W/kg (sheet thickness: 0.20 mm), 0.56 W/kg to 0.58 W/kg (sheet thickness: 0.23 mm), 0.62 W/kg to 0.63 W/kg (sheet thickness: 0.27 mm), and 0.72 W/kg to 0.73 W/kg (sheet thickness: 0.30 mm).

Subsequently, magnetic domain refining treatment was performed by irradiating with an electron beam under the irradiation conditions listed in Table 4 (in terms of $s_1$, in a range of 0.001 ms to 0.08 ms), iron loss was measured, and the number of generated rust spots after exposure for 48 hours at a temperature of 50° C. in a humid environment of 98% humidity was visually measured.

Table 5 lists the measurement results.

TABLE 4

| No. | Sheet thickness (mm) | Acceleration voltage (V) | Irradiation current (mA) | Irradiation diameter (μm) | Frequency (kHz) | Dot pitch d (mm) | Line spacing (mm) | Pressure in pressure chamber (Pa) | Irradiation pattern | Irradiation energy per unit length (J/m) | Irradiation energy per unit area (J/cm$^2$) |
|---|---|---|---|---|---|---|---|---|---|---|---|
| 1 | 0.23 | 60 | 12 | 205 | 100 | 0.30 | 5.0 | 0.5 | linear | 24 | 0.48 |
| 2 | 0.23 | 60 | 8 | 200 | 100 | 0.30 | 3.0 | 2.4 | linear | 16 | 0.53 |
| 3 | 0.23 | 60 | 3.2 | 190 | 12.5 | 0.35 | 5.0 | 0.4 | linear | 44 | 0.88 |
| 4 | 0.23 | 60 | 1.2 | 180 | 12.5 | 0.35 | 3.5 | 0.06 | linear | 16 | 0.47 |
| 5 | 0.23 | 40 | 4.2 | 195 | 12.5 | 0.30 | 5.0 | 0.02 | linear | 45 | 0.90 |
| 6 | 0.23 | 40 | 1.4 | 180 | 12.5 | 0.30 | 2.8 | 2.0 | linear | 15 | 0.53 |
| 7 | 0.23 | 150 | 4.5 | 195 | 100 | 0.25 | 5.0 | 0.05 | linear | 27 | 0.54 |
| 8 | 0.23 | 150 | 2.5 | 195 | 100 | 0.25 | 2.8 | 0.05 | linear | 15 | 0.54 |
| 9 | 0.23 | 60 | 12 | 205 | 1000 | 0.03 | 5.0 | 0.5 | linear | 24 | 0.48 |
| 10 | 0.23 | 60 | 8 | 200 | 1000 | 0.06 | 3.5 | 2.4 | linear | 8 | 0.23 |
| 11 | 0.23 | 60 | 4.5 | 190 | 50 | 0.20 | 10.0 | 0.5 | linear | 27 | 0.27 |
| 12 | 0.23 | 60 | 4.5 | 200 | 100 | 0.20 | 3.5 | 2.4 | linear | 14 | 0.39 |
| 13 | 0.23 | 60 | 7 | 190 | 100 | 0.25 | 6.0 | 2.4 | sinusoidal | 17 | 0.53 |
| 14 | 0.20 | 60 | 7 | 190 | 100 | 0.35 | 3.3 | 1.2 | linear | 12 | 0.69 |
| 15 | 0.27 | 60 | 7 | 190 | 100 | 0.35 | 3.3 | 1.5 | linear | 12 | 0.69 |
| 16 | 0.27 | 60 | 11 | 200 | 100 | 0.30 | 6.0 | 1.0 | linear | 22 | 0.70 |
| 17 | 0.30 | 60 | 7 | 190 | 100 | 0.35 | 3.3 | 2.2 | linear | 12 | 0.69 |

TABLE 5

| No. | Sheet thickness (mm) | $W_{17/50}$ before irradiation (W/kg) | $W_{17/50}$ after irradiation (W/kg) | Iron loss reduction amount $\Delta W_{17/50}$ (W/kg) | Iron loss reduction ratio $\Delta W$ (%) | Number of generated rust spots per unit area (number/cm$^2$) | Notes |
|---|---|---|---|---|---|---|---|
| 1 | 0.23 | 0.862 | 0.713 | −0.149 | 17 | 1.5 | Comparative Example |
| 2 | 0.23 | 0.876 | 0.723 | −0.153 | 17 | 0 | Example |
| 3 | 0.23 | 0.872 | 0.729 | −0.143 | 16 | 1.4 | Comparative Example |
| 4 | 0.23 | 0.874 | 0.721 | −0.153 | 18 | 0 | Example |
| 5 | 0.23 | 0.871 | 0.720 | −0.151 | 17 | 1.7 | Comparative Example |
| 6 | 0.23 | 0.861 | 0.708 | −0.153 | 18 | 0 | Example |
| 7 | 0.23 | 0.872 | 0.717 | −0.155 | 18 | 1.8 | Comparative Example |
| 8 | 0.23 | 0.861 | 0.701 | −0.160 | 19 | 0 | Example |
| 9 | 0.23 | 0.869 | 0.723 | −0.146 | 17 | 1.4 | Comparative Example |
| 10 | 0.23 | 0.864 | 0.718 | −0.146 | 17 | 0 | Example |
| 11 | 0.23 | 0.876 | 0.752 | −0.124 | 14 | 1.6 | Comparative Example |

TABLE 5-continued

| No. | Sheet thickness (mm) | $W_{17/50}$ before irradiation (W/kg) | $W_{17/50}$ after irradiation (W/kg) | Iron loss reduction amount $\Delta W_{17/50}$ (W/kg) | Iron loss reduction ratio $\Delta W$ (%) | Number of generated rust spots per unit area (number/cm$^2$) | Notes |
|---|---|---|---|---|---|---|---|
| 12 | 0.23 | 0.878 | 0.732 | −0.146 | 17 | 0 | Example |
| 13 | 0.23 | 0.863 | 0.705 | −0.158 | 18 | 0 | Example |
| 14 | 0.20 | 0.852 | 0.678 | −0.174 | 20 | 0 | Example |
| 15 | 0.27 | 0.874 | 0.737 | −0.137 | 16 | 0 | Example |
| 16 | 0.27 | 0.874 | 0.730 | −0.144 | 16 | 1.5 | Comparative Example |
| 17 | 0.30 | 0.997 | 0.899 | −0.098 | 10 | 0 | Example |

As shown in Table 5, by setting the electron beam irradiation conditions to 105 Z J/m or less per unit length and 1.0 Z to 3.5 Z J/cm$^2$ per unit area yielded a low iron loss grain-oriented electrical steel sheet with an iron loss reduction ratio $\Delta W$ of $(-500\ t^2+200\ t-6.5)$ % or more and an iron loss $W_{17/50}$ of $(5\ t^2-2\ t+1.065)$ W/kg or less. Furthermore, the fact that no rust was generated after the humidity cabinet test indicated that corrosion resistance did not deteriorate due to electron beam irradiation.

The invention claimed is:

1. A grain-oriented electrical steel sheet to which electron beam irradiation is applied, having a film and a thickness of t (mm), wherein no rust is produced on a surface of the steel sheet after a humidity cabinet test lasting 48 hours at a temperature of 50° C. in an atmosphere of 98% humidity, and an iron loss $W_{17/50}$ after the electron beam irradiation is reduced by at least $(-500\ t^2+200\ t-6.5)$ % of the iron loss $W_{17/50}$ before the electron beam irradiation and is $(5\ t^2-2\ t+1.065)$ W/kg or less.

2. The grain-oriented electrical steel sheet according to claim 1, wherein the film includes a film formed from colloidal silica and phosphate, and a forsterite film that is a base film of the film formed from colloidal silica and phosphate.

3. A method of manufacturing a grain-oriented electrical steel sheet having a film, comprising: irradiating the grain-oriented electrical steel sheet with an electron beam in a direction intersecting a rolling direction, setting electron beam irradiation conditions such that an irradiation energy of the electron beam per unit area of 1 cm$^2$ is 1.0 Z J to 3.5 Z J and the irradiation energy of the electron beam per unit irradiation length of 1 m is 105 Z J or less, where an irradiation time per irradiation interval d (mm) of the electron beam is $s_1$ (ms), and $Z = s_1^{0.35}$.

4. The method according to claim 3, further comprising setting the irradiation interval d (mm) to 0.01 mm to 0.5 mm and setting the irradiation time $s_1$ (ms) to 0.003 ms to 0.1 ms.

5. The method according to claim 3, wherein the film includes a film formed from colloidal silica and phosphate, and a forsterite film that is a base film of the film formed from colloidal silica and phosphate.

6. The method according to claim 4, wherein the film includes a film formed from colloidal silica and phosphate, and a forsterite film that is a base film of the film formed from colloidal silica and phosphate.

* * * * *